US009991084B2

(12) United States Patent
Camara et al.

(10) Patent No.: US 9,991,084 B2
(45) Date of Patent: Jun. 5, 2018

(54) CONTINUOUS CONTACT X-RAY SOURCE

(71) Applicant: Tribogenics, Inc., Los Angeles, CA (US)

(72) Inventors: Carlos G. Camara, Los Angeles, CA (US); Mark G. Valentine, Los Angeles, CA (US); Zachary J. Gamlieli, Los Angeles, CA (US); Benjamin A. Lucas, Los Angeles, CA (US); David M. Kamkar, Los Angeles, CA (US); Pedro Cortes, Jr., Los Angeles, CA (US); Vasish Narayan M., Los Angeles, CA (US); Gilberto Jimenez, Los Angeles, CA (US); Daniel E. Cuadra, Los Angeles, CA (US)

(73) Assignee: Tribo Labs, Marina Del Rey, CA (US)

( * ) Notice: Subject to any disclaimer, the term of this patent is extended or adjusted under 35 U.S.C. 154(b) by 0 days. days.

(21) Appl. No.: 15/652,102

(22) Filed: Jul. 17, 2017

(65) Prior Publication Data

US 2018/0068822 A1 Mar. 8, 2018

Related U.S. Application Data

(63) Continuation of application No. 14/679,776, filed on Apr. 6, 2015, now Pat. No. 9,728,368, which is a (Continued)

(51) Int. Cl.
*H01J 35/00* (2006.01)
*H01J 35/08* (2006.01)
(Continued)

(52) U.S. Cl.
CPC ..... *H01J 35/08* (2013.01); *H01J 35/02* (2013.01); *H01J 35/06* (2013.01); *H01J 35/18* (2013.01);
(Continued)

(58) Field of Classification Search
CPC ..... H01J 35/00; H01J 35/02
See application file for complete search history.

(56) References Cited

U.S. PATENT DOCUMENTS 2,810,077 A 10/1957 Gale
3,612,918 A 10/1971 Willutzki
(Continued)

FOREIGN PATENT DOCUMENTS

JP 05-290993 A 11/1993
JP 2010-199292 A 9/2010
(Continued)

OTHER PUBLICATIONS

Klyuev et al., "The effect of air pressure on the parameters of x-ray emission accompanying adhesive and cohesive breaking solids", Sov. Phys. Tech. Phys., vol. 34, Mar. 1989, pp. 361-364.
(Continued)

*Primary Examiner* — Dani Fox
(74) *Attorney, Agent, or Firm* — Klein, O'Neill & Singh, LLP

(57) ABSTRACT

An x-ray device utilizes a band of material to exchange charge through tribocharging within a chamber maintained at low fluid pressure. The charge is utilized to generate x-rays within the housing, which may pass through a window of the housing. Various contact rods may be used as part of the tribocharging process.

16 Claims, 16 Drawing Sheets

Related U.S. Application Data continuation of application No. 13/844,128, filed on Mar. 15, 2013, now Pat. No. 9,008,277.

(51) Int. Cl.

| | |
|---|---|
| ***H01J 35/06*** | (2006.01) |
| ***H01J 35/02*** | (2006.01) |
| ***H05G 2/00*** | (2006.01) |
| ***H01J 35/20*** | (2006.01) |
| ***H01J 35/18*** | (2006.01) |

(52) U.S. Cl.

CPC ..... *H01J 35/20* (2013.01); *H05G 2/00* (2013.01); *H01J 2235/186* (2013.01)

(56) References Cited

U.S. PATENT DOCUMENTS

| | | | | |
|---|---|---|---|---|
| 4,789,802 | A | 12/1988 | Miyake | |
| 4,990,813 | A * | 2/1991 | Paramo | H02N 1/04 310/308 |
| 5,665,969 | A | 9/1997 | Beusch | |
| 6,476,406 | B1 | 11/2002 | Struye et al. | |
| 6,493,423 | B1 | 12/2002 | Bisschops | |
| 6,668,039 | B2 | 12/2003 | Shepard et al. | |
| 6,925,151 | B2 | 8/2005 | Harding et al. | |
| 7,060,371 | B2 | 6/2006 | Akiyama et al. | |
| 7,596,242 | B2 | 9/2009 | Breed et al. | |
| 8,019,046 | B1 | 9/2011 | Underwood et al. | |
| 2009/0050847 | A1 | 2/2009 | Xu et al. | |
| 2011/0130613 | A1 | 6/2011 | Putterman et al. | |

FOREIGN PATENT DOCUMENTS

| | | | |
|---|---|---|---|
| JP | 2012-186149 | A | 9/2012 |
| WO | WO 2009-102784 | A1 | 8/2009 |
| WO | WO 2012-154494 | A2 | 11/2012 |

OTHER PUBLICATIONS

Nakayama et al., "Triboemission of charged particles and photons from solid surfaces during frictional damage", Journal of Physics D. Applied Physics, vol. 25, No. 2, Feb. 14, 1992, pp. 303-308.

Nishitani et al., "STM tip-enhanced photoluminescence from porphyrin film", Surface Science, North-Holland Publishing Co., vol. 601, No. 17, Aug. 23, 2007, pp. 3601-3604.

Ohara et al., "Light emission due to peeling of polymer films from various substrates", Journal of Applied Polymer Science, vol. 14, No. 8, Aug. 1, 1970, pp. 2079-2095.

Stefan Kneip, "A stroke of X-ray", Nature, vol. 473, May 26, 2011, pp. 455-456.

Carlos G. Camara et al., "Correlation between nanosecond X-ray flashes and stick-slip friction in peeling tape", Nature, vol. 455, Oct. 23, 2008, pp. 1089-1092.

Hird et al., "A triboelectric X-ray Source", Applied Physics Letters (2001).

International Search Report on related PCT Application No. PCT/US2014/027762 from International Searching Authority (KIPO) dated Aug. 21, 2014.

Written Opinion on related PCT Application No. PCT/US2014/027762 from International Searching Authority (KIPO) dated Aug. 21, 2014.

Extended European Search Report on related European Application No. 14763409.1 from European Patent Office (EPO) dated Oct. 28, 2016.

Office action on related Chinese Patent Application No. 201480019698.X from State Intellectual Property Office (SIPO) dated Sep. 1, 2016.

Office action on related Japanese Patent Application No. 2016-502535 from Japan Patent Office (JPO) dated Oct. 25, 2016.

Search Report on related Russian Patent Application No. 2015143830 from the Federal Institute of Industrial Property (FIIP) dated Feb. 28, 2017.

U.S. Appl. No. 14/679,776, filed Apr. 6, 2015, Camara et al., US 2015-0213993 A1, Office Action dated Oct. 7, 2016, Notice of Allowance dated Apr. 10, 2017; May 11, 2017.

* cited by examiner

CONTINUOUS CONTACT X-RAY SOURCE

CROSS-REFERENCE TO RELATED APPLICATIONS

The present application is a continuation of U.S. patent application Ser. No. 14/679,776, filed Apr. 6, 2015, which is a continuation of U.S. patent application Ser. No. 13/844,128, filed Mar. 15, 2013, now U.S. Pat. No. 9,008,277, the disclosures of which are incorporated by reference herein.

BACKGROUND OF THE INVENTION

The present invention relates generally to generation of high-energy radiation, and more particularly to generation of high energy radiation by mechanical motion.

X-rays are used in a variety of ways. X-rays may be used for medical or other imaging applications, crystallography related applications including material analysis, or in other applications.

X-rays are generally generated by electron braking (bremmstrahlung) or inner shell electron emission within a material. Historically, other than through natural phenomena, x-rays generally have been generated by accelerating electrons into a material, such as a metal, with a small proportion of the electrons causing x-rays through bremmstrahlung or knocking electrons present in the material out of inner orbitals, for example K-shell orbitals, with x-rays being generated as electrons in higher energy orbitals transition to the lower energy orbitals. Acceleration of the electrons to generate a useful quantity of x-rays, however, generally requires expenditure of significant power, particularly when considering the small percentage of such electrons which actually result in x-ray emissions.

X-rays may also be generated by changes in mechanical contact between materials in a controlled environment, for example through the unpeeling of pressure sensitive adhesive tape or mechanical contact of some materials in an evacuated chamber. However, utilization of such methods to provide a sufficient intensity of x-rays to be commercially useful, and doing so outside of a laboratory environment, may be difficult.

BRIEF SUMMARY OF THE INVENTION

Some aspects of the invention provide an x-ray device utilizing a continuous band, with the continuous band in or at least partially in a low fluid pressure environment.

In one aspect, the invention provides an x-ray device comprising: a housing configured for maintenance of a low fluid pressure environment in a chamber of the housing, the housing having a window, the housing being substantially opaque to x-rays other than the window, which is substantially transparent to x-rays; a driving roller; a motor for driving the driving roller; contact material, a contact rod in some aspects of the invention, at least partially within the chamber; a band, a continuous band in some aspects of the invention, looped around the driving roller and in contact with the contact material, with in some aspects of the invention the band and the contact material being of materials selected such that charging surface contact between the two results in generation of a relative charge imbalance; and a target shelf within the chamber proximate the contact rod, the target shelf having a surface for an electron target. In some such aspects the band is comprised of an electrically insulating material and the contact material is comprised of an electrically conductive material. In some aspects the reverse is true.

These and other aspects of the invention are more fully comprehended upon review of this disclosure.

DETAILED DESCRIPTION

Figure 1:
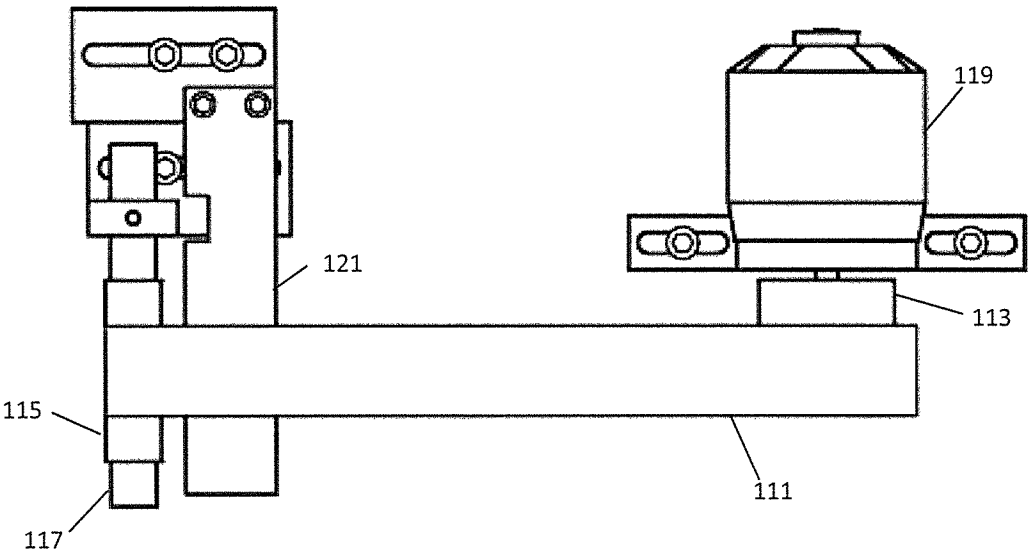
FIG. 1 is a top view of portions of a device in accordance with aspects of the invention.
Figure 2:
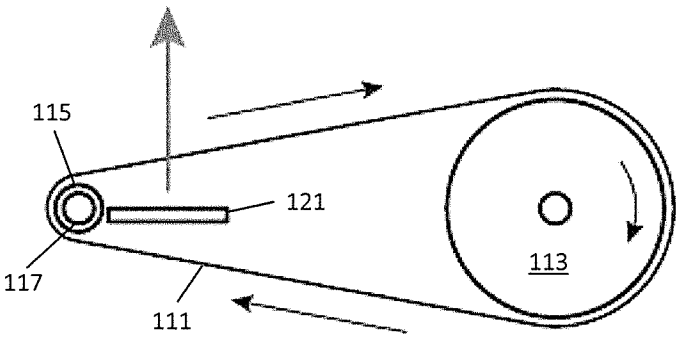
FIG. 2 is a side view of portions of the device of FIG. 1 in accordance with aspects of the invention.
Figure 3:
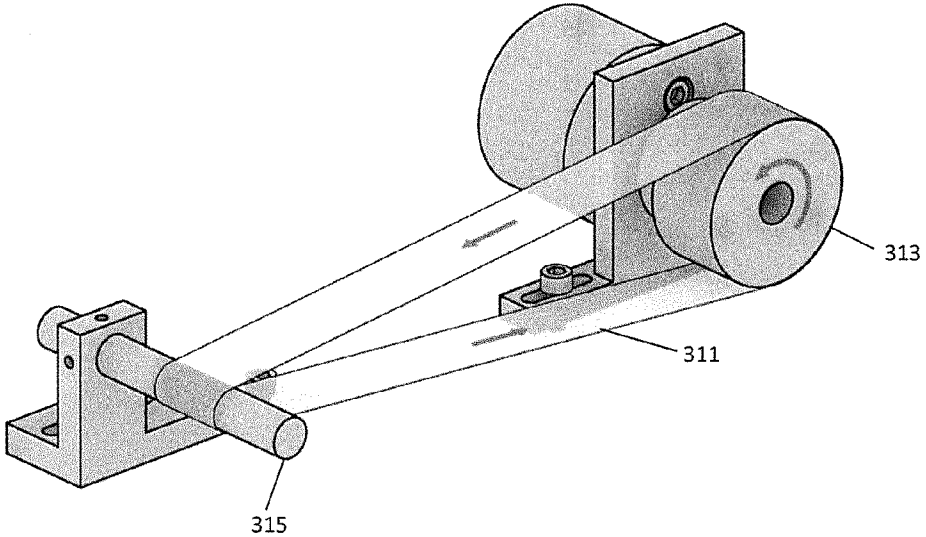
FIG. 3 is a perspective view of portions of the device of FIGS. 1 and 2 in accordance with aspects of the invention.

FIGS. 1-3 show views of representations of portions of a device for x-ray generation in accordance with aspects of the invention. In most embodiments the portions of the device shown in FIGS. 1-3 are enclosed in one or more chambers of a housing configured for maintenance of a low fluid pressure environment. In some embodiments only some portions may be so enclosed. For example, in some embodiments a motor of the device may not be so enclosed, and in some embodiments only portions of a device proximate to (and including) a target shelf may be so enclosed. In such various embodiments, generally the housing is substantially opaque to x-rays, other than a window which is substantially transparent to x-rays.

The device includes a band 111 looped between a drive roller 113 and a contact material 117. The band may be a continuous band, although various embodiments may include bands that are not continuous. In some embodiments the band may be comprised of material that varies within or across the band. In some embodiments the band may comprise a plurality of bands, of which some or all may have varying or the same properties. The contact material may be in the form of a rod, or may be in the form of another structure, or may provide a surface of or covering for a rod or other structure. For convenience, generally herein the contact material may be referred to as a contact rod, a rod, or a contact. The drive roller is driven by a motor 119, which results in rotation of the band. As the band rotates, the band slides against a surface 115 of the contact rod. Material of the band and material of the surface of the contact rod are selected such that varying contact of areas of surface of the band with the surface of the contact rod results in generation of a charge imbalance, through tribocharging in various embodiments. Preferably the tribocharging results in relative charge accumulation on portions of the band when in varying contact with the surface of the rod, in many embodiments negative charge accumulation, but in some embodiments the relative charge accumulation on the band may be positive charge accumulation. In some embodiments the band comprises an electrically insulating material. In some embodiments the band comprises a polyimide membrane. In some embodiments the band comprises a Kapton membrane. In some embodiments the surface of the rod comprises an electrically conductive material. In some embodiments the surface of the rod comprises a metal such as silver. In some embodiments the surface of the contact comprises Molybdenum. In some embodiments the rod is a metal rod, and in some embodiments the rod is a Molybdenum or Molybdenum alloy rod.

The device also includes a target shelf 121 for carrying an electron target. As shown in FIG. 2, providing a side view of representational portions of the device of FIGS. 1-3, the target shelf is proximate the contact rod, and has a surface on which electron targets may be placed facing somewhat towards locations of the contact rod at which the band exits contact with the contact rod during rotation of the band. As the band exits contact with the contact rod, the portion of the band exiting such contact discharges excess electrons resulting from negative charge accumulation on the band.

In some embodiments, and as may be seen through a comparison of FIGS. 2 and 3, the continuous band may be driven in a reverse direction, as shown for example in FIG. 3. Reversal of the direction of the continuous band, for example on a periodic basis, which may be infrequent, may be beneficial in reapplying lubricant previously applied to the band or contact rod, for example a solid lubricant previously applied to the band or contact rod, as the lubricant may be dispersed and possibly collected at other locations during operation.

Figure 4:
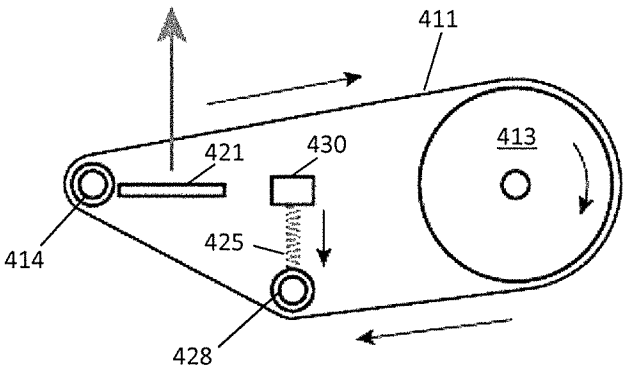
FIG. 4 is a side view of portions of a device, including a tensioner, in accordance with aspects of the invention.

FIG. 4 shows portions of a device in accordance with aspects of the invention. The portions of the device shown in FIG. 4 are similar to some of the portions of the device of FIGS. 1-3, but additionally include a band tensioner assembly, which also may be used in some embodiments of the device of FIGS. 1-3. The device of FIG. 4 includes a continuous band 411 looped around a drive roller 413, a tensioner, and a contact rod 414. The tensioner, for example, and as illustrated in FIG. 4 comprises a biasing roller 428, a spring 425, and a base 430. The spring is coupled between the base and biasing roller, and biases the biasing roller 428 against the continuous band 411 to increase tension in the continuous band. As with the device of FIG. 1-3, the drive roller is driven by a motor (not shown), which results in rotation of the continuous band 411 in the direction of the arrows adjacent to the continuous band. As the continuous band rotates, surface portions of the continuous band pass over the surface of contact rod 414. Material of the continuous band 411 and surface material of the contact rod 414 are selected such that the rotation of the continuous band results in generation of a charge imbalance through tribocharging. The increased tension of the continuous band 411 caused by the tensioner produces additional charge through the increased force of friction between the continuous band 411 and the contact rod 414. The continuous band discharges electrons on to a target material (not shown) on electron target 421. The target material (not shown) on electron target 421 then discharges x-rays in the direction indicated by the vertical arrow of FIG. 4, through a window (not shown) transparent to x-rays.

Figure 5:
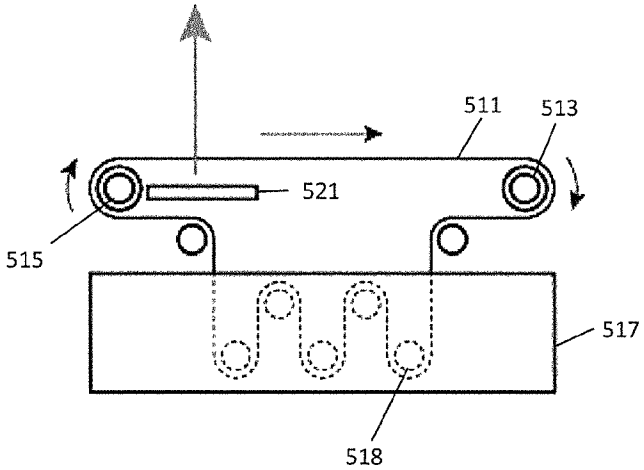
FIG. 5 is a side view of portions of a device, including a roller cassette, in accordance with aspects of the invention

FIG. 5 shows portions of a device in accordance with aspects of the invention. The portions of the device shown in FIG. 5 are similar to some of the portions of the device of FIGS. 1-3, but additionally include a cassette assembly, which may be used in some embodiments of the device of FIGS. 1-3. The device of FIG. 5 includes a continuous band 511, a drive roller 513, a contact rod 515, a electron target 421, and a cassette 517, comprising a plurality of rollers 518. As with the device of FIGS. 1-3, the drive roller 513, driven by a motor (not shown) rotates the band in the direction of the arrows shown adjacent to the continuous band 511. The continuous band enters cassette 517, where the continuous band follows a serpentine path over a plurality of rollers 518. The cassette structure allows for increased length of the continuous band 511 without greatly increasing size of the overall assembly. A longer continuous band 511 has a longer service life, which may reduce the frequency with which the housing of the assembly (not shown) must be opened, and then resealed and evacuated, to service or replace the continuous band 511. As with other embodiments, as the continuous band 511 continues to rotate, the continuous band 511 passes over the surface of the contact rod 515. Material of the continuous band 511 and surface material of the contact rod 515 are selected such that serial contact by sections of the band with the surface of the contact rod results in generation of a charge imbalance through tribocharging. The continuous band discharges electrons on to a target material (not shown) on electron target 521. The target material (not shown) on electron target 521 then discharges x-rays in the direction indicated by the vertical arrow of FIG. 5, through a transparent x-ray window (not shown). In various embodiments the cassette has 5, 7, or more rollers.

Figure 6:
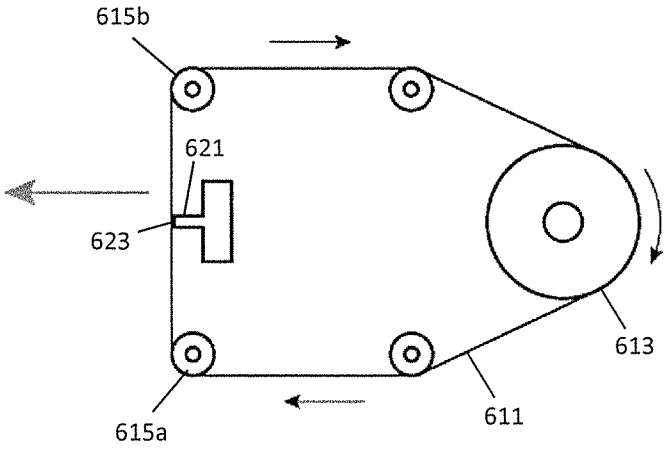
FIG. 6 is a side view of portions of a device, with an alternative contact rod cross section, in accordance with aspects of the invention.

FIG. 6 is a side view of portions of a device in accordance with aspects of the invention. The portions of the device of FIG. 6 may be used, for example, in place of the portions of the device shown in FIG. 2. In FIG. 6, a continuous band is looped around a drive roller 613, which may be driven by a motor, a contact rod 623, and a plurality of guide rollers, for example guide rollers 615*a,b*. In the embodiment of FIG. 6, the guide rollers 615*a,b* guide the band to approach and depart from the contact rod in a linear fashion, which allows for a different direction of emissions of x-rays and for tensioning of the band by way of adjustment of position of the contact rod.

As shown in FIG. 6, the contact rod has a substantially sideways T shaped cross section, with an extending tip of the sideways T in contact with the band. Application of pressure on the top of the T forces the tip of the T into the band, increasing tension on the band and the force of frictional contact between the contact rod and the band. In addition, the shape of the contact rod 621 naturally forms a shelf for placement of an electron target, or in some embodiments to serve as an electron target itself, for example for uses with electron excited x-ray fluorescence.

Figure 7:
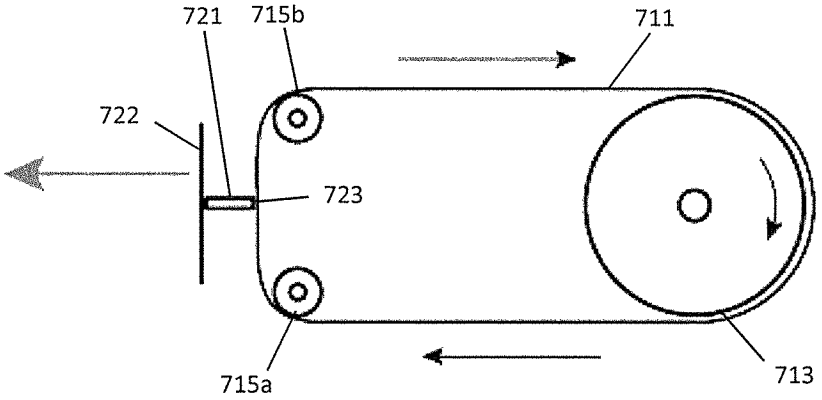
FIG. 7 is a side view of portions of a device, with a contact rod placed exterior of the area defined by a continuous band path, in accordance with aspects of the invention.

FIG. 7 is a side view of portions of a device in accordance with aspects of the invention. The portions of the device of FIG. 7 may be used, for example, in place of the portions of the device shown in FIG. 2. The portions of the device shown in FIG. 7 are similar to those of the device of FIG. 6, with relative position of the continuous band and the contact rod reversed. As in FIG. 6, in FIG. 7 a continuous band is looped around a drive roller 713, which may be driven by a motor and a plurality of guide rollers, for example guide rollers 715*a,b*. Also as in the embodiment of FIG. 7, the guide rollers 715*a,b* guide the band to approach and depart from the contact rod in a linear fashion. Unlike the device of FIG. 6, however, the contact rod is not inside a circle defined by the band, instead the contact rod is outside such a circle, with the contact rod in changing contact with an exterior surface of the band. In this embodiment, the band charges negative from contact with the rod material. This causes electrons to accelerate towards a transmission target, such as a Ag sputtered Be window 722. When the electrons strike the target window, x-rays are generated, some of which travel trough the window.

Figure 8B:
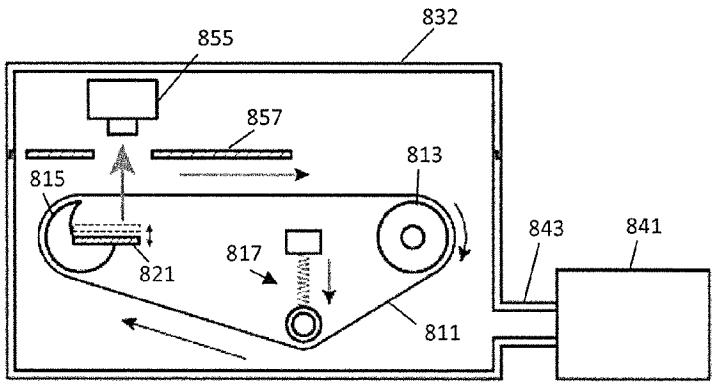
FIG. 8B is a side view of portions of a device including an x-ray measuring device internal to a chamber of the device, in accordance with aspects of the invention.
Figure 8A:
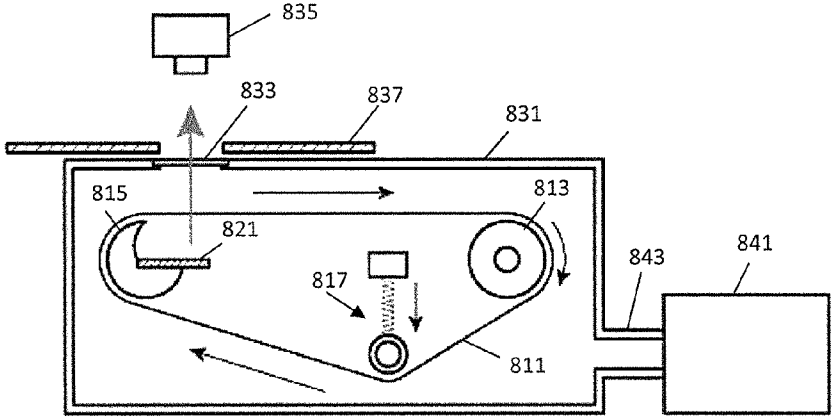
FIG. 8A is a side view of portions of a device, with an alternative contact rod cross section and tensioner, in accordance with aspects of the invention.

FIG. 8A is a semi-block diagram of portions of a device in accordance with aspects of the invention. The device of FIG. 8A, generally as with the other devices, includes a drive roller 813, a contact rod 815, and a continuous band 811 looped around the drive roller and contact rod. The device of FIG. 8 additionally includes a band tensioner 817 for adjusting tension of the band, and therefore force of frictional contact between the band and the contact rod. In operation, the frictional contact between the band and the contact rod, with materials of the band and the contact rod as previously discussed, results in negative charge accumulation on the band about portions of the band exiting contact with the contact rod, allowing for acceleration of electrons into a target 821 on a target shelf of the contact rod.

The diagram of FIG. 8A additionally shows a housing 831 providing a chamber for the band and the drive roller and contact rod. The housing is configured to maintain a controlled fluid pressure environment, for example less than 200 mTorr, within the chamber, through use of a vacuum pump 841 coupled to the chamber by way of a port 843 in the housing. In some embodiments a pressure gauge may be also included, to monitor interior partial pressure of the chamber. The housing, substantially opaque to x-rays in many embodiments, also includes a window 833, with the window substantially transparent to x-rays. Also as shown in the diagram of FIG. 8A, a collimator 837, for example an x-ray absorbing material with an aperture therethrough, is provided outside the housing about the window. The collimator serves to prevent extraneous x-rays generated within the housing from other than the target material from reaching a measuring device 835, which may be for example an x-ray detector or sensor or x-ray camera. In some embodiments, for example embodiments in which a tray includes multiple different areas for different materials which may serve as targets, the collimator may be movable so as to effectively select a particular material for measurement.

FIG. 8B is a semi-block diagram of portions of a device in accordance with aspects of the invention. The device of FIG. 8B is similar to the device of FIG. 8A, but with the collimator and x-ray measurement device within the housing.

The device of FIG. 8B, like the device of FIG. 8A includes the drive roller 813, contact rod 815, and continuous band 811 looped around the drive roller and contact rod, with a tensioner 817 for adjusting tension of the band. A housing 832 provides a chamber for the band, drive roller, and contact rod, with the housing configured to maintain a controlled fluid pressure environment, for example through use of the vacuum pump 841 coupled to the chamber by way of the port 843 in the housing.

Also within the housing is an x-ray measurement device 855, for example an x-ray detector, sensor, or camera, with a collimator 857 within the housing between an electron target and the x-ray measurement device. In some embodiments, for example embodiments in which a tray with multiple different areas for different materials is used, the collimator may be moveable to effectively select a particular material for measurement.

FIGS. 9A-9K show various embodiments of contact rods, which for example may be used in the devices discussed herein.

Figure 9A:
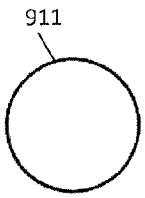
FIG. 9A shows a cross section of an embodiment of a contact rod in accordance with aspects of the invention.

FIG. 9A shows a cross section of a contact rod 911 in accordance with aspects of the invention. The cross section is circular, which reduces some friction to prevent premature wear of the continuous band (not shown).

Figure 9B:
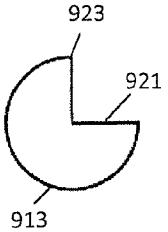
FIG. 9B shows a cross section of an embodiment of a contact rod in accordance with aspects of the invention.

FIG. 9B shows a cross section of a contact rod 913 in accordance with aspects of the invention. The cross section is partially circular. An approximately 90 degree radial section starting at 923 and continuing clockwise of the cross section of the contact rod 913 has been removed along the longitude of the contact rod 913. This cross section generally leaves surface material of the contact rod 913 that comes into contact with the continuous band (not shown) in place, but also provides for a more defined point or line of loss of contact between the contact rod and the continuous band. In one embodiment, an electron target may be placed on top of radial section face 921, allowing for closer positioning of the electron target to charge collection areas.

Figure 9C:
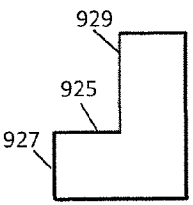
FIG. 9C shows a cross section of an embodiment of a contact rod in accordance with aspects of the invention.

FIG. 9C shows a cross section of an L-shaped contact rod 929 in accordance with aspects of the invention. A continuous band (not shown) passes over a face 927 and includes a face 925 for placing an electron target. As with the contact rod of FIG. 9B, the contact rod of FIG. 9C provides for a more well defined loss of contact line between the contact rod and the continuous band, as well as providing for alternate positioning of electron targets. In addition, in some embodiments, the contact rod of FIG. 9C may be used for emission of high density radiation in a direction different than the direction of emission of radiation in other embodiments.

Figure 9D:
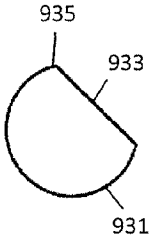
FIG. 9D shows a cross section of an embodiment of a contact rod in accordance with aspects of the invention.

FIG. 9D shows a cross section of a contact rod 931 in accordance with aspects of the invention. The cross section comprises a section of the contact rod 931 starting at 935 and defining planar face 933. In addition, a target electron target may be mounted on the face defined by face 933.

Figure 9E:
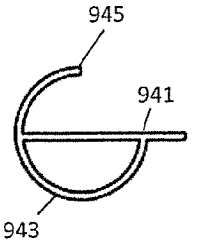
FIG. 9E shows a cross section of an embodiment of a contact rod in accordance with aspects of the invention.

FIG. 9E shows a cross section of a contact rod 943 in accordance with aspects of the invention. The cross section comprises of semi-cylindrical shell 945, and an integrated target electron target 941. In addition, the arcuate section of the semi-cylindrical shell 945 with the free end flexes as the continuous band (not shown) passes over it, possibly increasing electrical energy discharge from the continuous band.

Figure 9F:
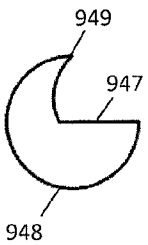
FIG. 9F shows a cross section of an embodiment of a contact rod in accordance with aspects of the invention.

FIG. 9F shows a cross section of a contact rod 948 in accordance with aspects of the invention. The cross section comprises a semi-circular portion with a face 947, and a half-crescent shaped section 949 extending from a portion of the face 947. As with some other embodiments, the cross section of FIG. 9F provides for a more well defined loss of contact line between the contact rod and the continuous band at the tip of the half crescent, as well as providing for alternate positioning of electron targets on the electron target.

Figure 9G:
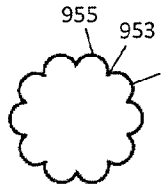
FIG. 9G shows a cross section of an embodiment of a contact rod in accordance with aspects of the invention.

FIG. 9G shows a cross section of a contact rod 951 in accordance with aspects of the invention. The outer surface of the contact rod is defined by a plurality of rounded ridges 955 alternating with V-shaped recesses 953. A paste for lubrication of the band, or for increasing charge on the continuous band (not shown) can be placed on the surface, and will settle in the V-shaped recesses 953, with the recesses serving for example as reservoirs.

Figure 9H:
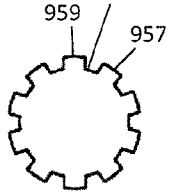
FIG. 9H shows a cross section of an embodiment of a contact rod in accordance with aspects of the invention.

FIG. 9H shows a cross section of a contact rod 957 in accordance with aspects of the invention. The outer surface of the contact rod is defined by a plurality of square ridges 959 raised from the surface 958 of the contact rod 957. A lubricant or a paste for increasing the charge on the continuous band (not shown) can be placed on the surface, and will settle on the surface 958 of the contact rod 957 between the square ridges 959.

Figure 9I:
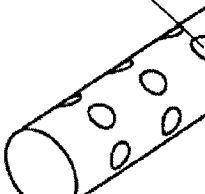
FIG. 9I shows a cross section of an embodiment of a contact rod in accordance with aspects of the invention.

FIG. 9I shows a perspective view of a contact rod 961 in accordance with aspects of the invention. The surface of the contact rod 961 has a plurality of dimples 963 arranged in rows at intervals around the circumference of the contact rod 961. A paste for increasing the charge on the continuous band (not shown) can be placed on the surface, and will settle in the dimples 963 of the contact rod 961. As with some of the other embodiments, the dimples may serve as reservoirs for lubricants or various pastes.

Figure 9J:
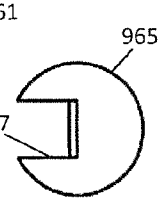
FIG. 9J shows a cross section of an embodiment of a contact rod in accordance with aspects of the invention.

FIG. 9J shows a cross section of a contact rod 965 in accordance with aspects of the invention. In this embodiment the gap in the cross section allows electrical energy to flow from the continuous band (not shown) onto target face 967. The path for this flow is advantageously short.

Figure 9K:
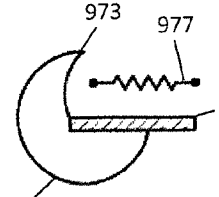
FIG. 9K shows a cross section of an embodiment of a contact rod in accordance with aspects of the invention.

FIG. 9K shows a cross section of the contact rod of FIG. 9F with the addition of an electron target 975 and a charged filament 977 in accordance with aspects of the invention. The filament could be for example made of Tungsten, or a Tungsten alloy, or Barium Oxide, or some other electron emitter. The electron emission from such a filament can be controlled by connection to a power source, such as a battery, for example through electrical vacuum contacts (not shown). As electrons flow from the continuous band (not shown) at the tip of half crescent shaped section 973 to the electron target 975, the flow picks up additional electrons from the charged filament 977, thereby increasing the charge that reaches the plate and, ultimately, the x-rays generated by the target.

Figure 10:
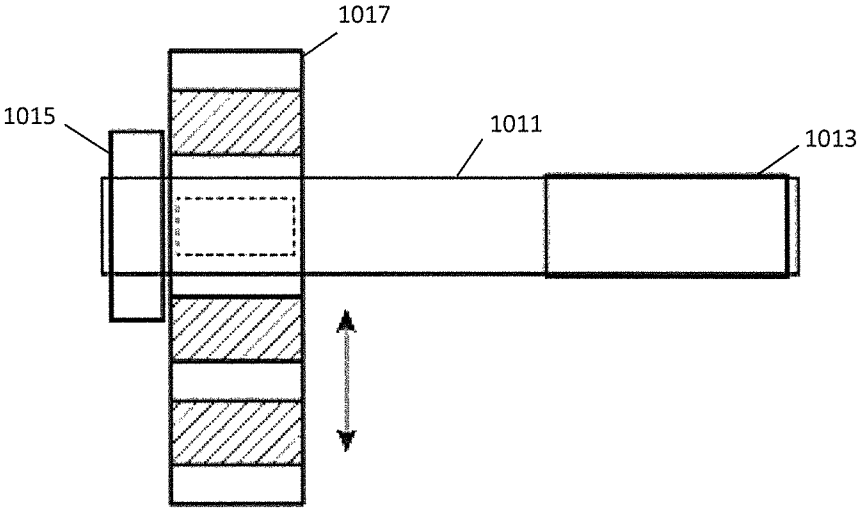
FIG. 10 is a top view of portions of a device, showing an embodiment of an electron target, in accordance with aspects of the invention.

FIG. 10 shows a portion of device in accordance with aspects of the invention. The portions of the device shown in FIG. 10 are similar to some of the portions of the device of FIGS. 1-3, but additionally include an electron target tray 1017, which may be adjusted in the direction of the arrows in FIG. 10 by an adjustment device (not shown) on an exterior of a housing (not shown). The portion of the device further includes a continuous band 1011, a drive roller 1013, and a contact rod 1015. As a motor (not shown) turns the drive roller, the drive roller rotates the continuous band. The charge produced by the contact of the band and the contact rod causes electrons to flow to the electron target on the electron target tray 1017. The individual electron targets on the target tray are sufficiently spaced so that only one target is affected by the electron flow at any given time. When a different electron target is desired the operator can use the adjustment device to move the next desired target on the target tray under the path of the belt. The target tray 1017, by providing multiple targets allows for control of the spectral distribution of the x-ray emission, for example by having an Au and Ag target the characteristic excitation lines of the different target materials will be present in the x-ray spectrum. Furthermore, the target materials can electrically connected to ground or disconnected through a conductive material such as a Copper cable (not shown). The targets can also be connected to a power source, such as an electrical power supply, to provide a bias voltage for further control of the electron discharge.

Figure 11A:
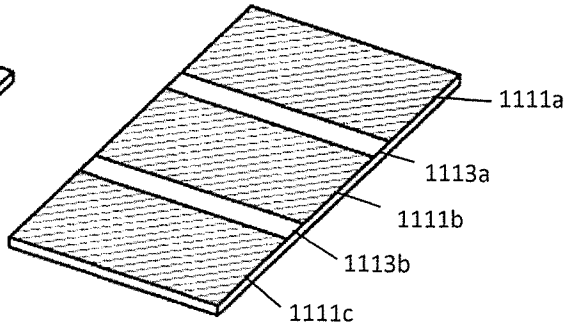
FIG. 11A is a perspective view of an embodiment of an electron target tray.
Figure 11B:
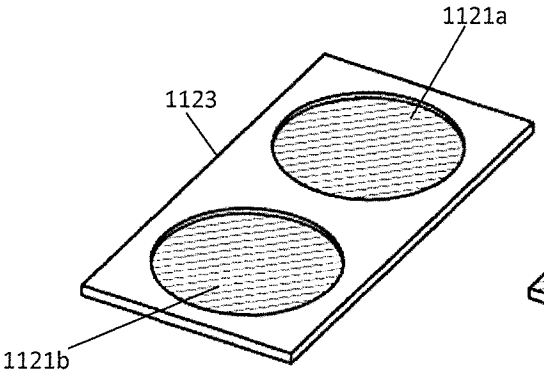
FIG. 11B is a perspective view of an embodiment of an electron target tray.

FIG. 11B shows a target tray 1123, with targets 1121*a*, 1121*b* for use in the portion of the device of FIG. 10. In this embodiment, the targets are circular shaped.

FIG. 11A shows a target tray, with targets 1111*a*, 1111*b*, and 1111*c* for use in the portion of the device of FIG. 10. The targets are separated by non-x-ray producing material in sections 1113*a* and 1113*b*, such as a plastic or generally a material with low Z number. In this embodiment, the targets are rectangle shaped.

Figure 11C:
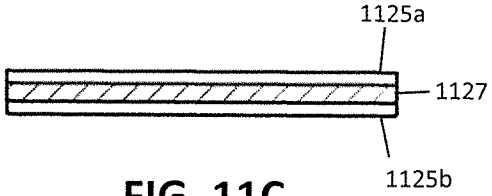
FIG. 11C is a side view of an embodiment of an electron target tray.

FIG. 11C shows another embodiment of the target tray in accordance with aspects of the invention. In this embodiment, two target materials 1125*a* and 1125*b* are held by a shelf 1127 such that when the band is rotated in one direction, say clockwise as shown in FIG. 2, the emission takes place from the target labeled 1125*a*. Alternatively, when the band is rotated counterclockwise, the emission takes place from the target material labeled 1125*b*.

Figure 12:
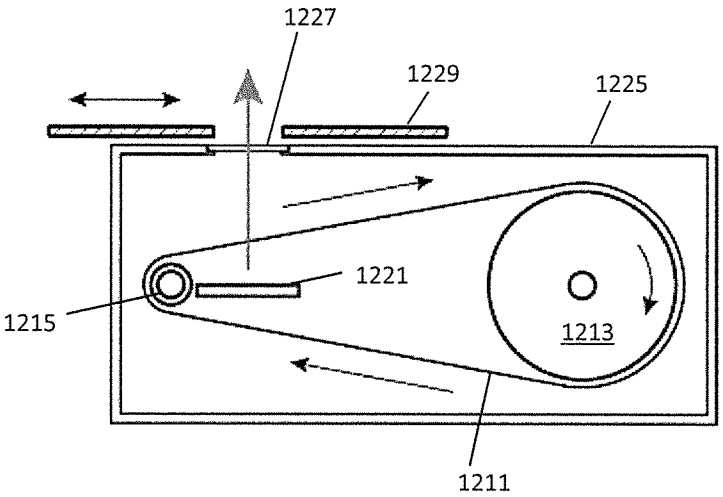
FIG. 12 is a side view of portions of a device, with an adjustable x-ray emission window, in accordance with aspects of the invention.

FIG. 12 shows portions of a device in accordance with aspects of the invention. The device of FIG. 12, generally as with the other devices, includes a drive roller 1213, a contact rod 1215, and a continuous band 1211 looped around the drive roller and contact rod. A target shelf 1221 is provided proximate the contact rod, within a loop formed by the band. Materials and operation of the device of FIG. 12 may be as discussed with respect to the device of FIGS. 1-3.

In some embodiments the target shelf receives target trays including different materials serving as electron targets, and the trays may be for example the trays discussed with respect to FIGS. 11A and 11B. Movement of the tray, for example as discussed with respect to FIG. 10, may not always be desirable, considering for example that the tray is within a housing 1225 enclosing a chamber at a low fluid pressure. Accordingly, the device of FIG. 12 includes a moveable collimator 1229 outside a substantially x-ray transparent window 1227 of the housing. Movement of the collimator, for example by translation through a distance equal to electron target separation on the tray, allows for passage of generally only x-rays generated by particular targets. A sensing device outside of the housing (and collimator) therefore may sense only x-rays generated from a desired target material.

Figure 13:
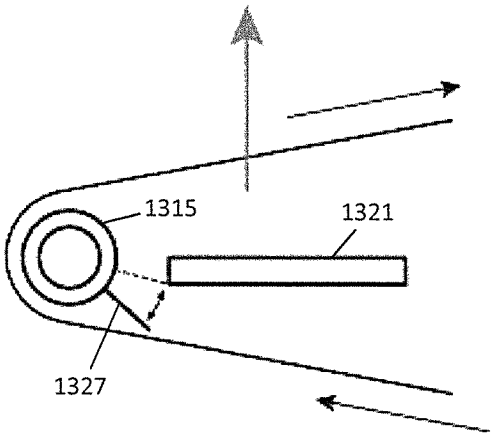
FIG. 13 is a side view of portions of a device, with a contact rod including a cantilever, in accordance with aspects of the invention.

FIG. 13 shows a portion of device in accordance with aspects of the invention. The portions of the device shown in FIG. 13 are similar to some of the portions of the device of FIGS. 1-3, but additionally include a contact rod 1315 with a cantilever 1327, which also may be used in some embodiments of the device of FIGS. 1-3. The device of FIG. 13 includes a continuous band moving in the direction indicated by the arrows adjacent to the band, and an electron target 1321. The cantilever moves from a first position contacting the continuous band to a second position contacting the electron target. As the cantilever comes into contact with the continuous band it grounds a portion of the band to the contact rod 1315. When the cantilever contacts the electron target, the contact rod is grounded to the electron target. Grounding of the band may reduce unwanted charge levels on the band prior to generation of charge through contact with the contact rod. The cantilever 1327 can act as an electrical connection between the contact rod 1315 and the target shelf 1321. Controlling the amount of charge on the shelf can further control the rate of discharge to the target. In some embodiments a voltage might be applied to the target shelf by means of an electrical connection to a power source, such as a power supply (not shown). In some embodiments, the cantilever removes debris from the continuous band as they come into contact. This acts to alleviate a potential maintenance issue inherent in the device.

Figure 14:
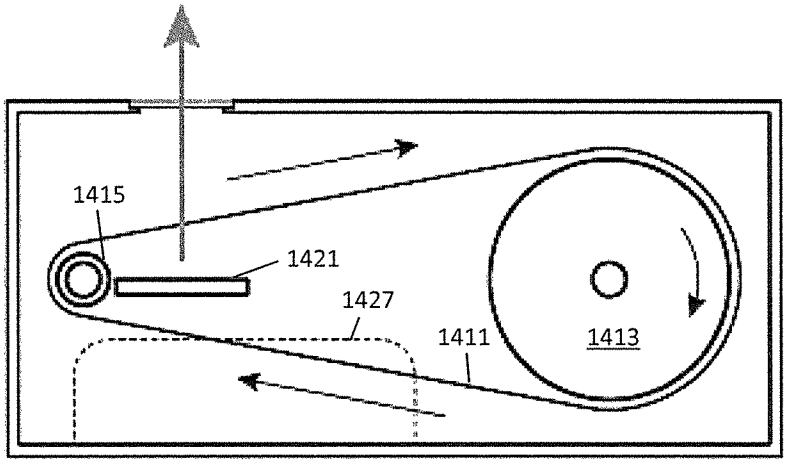
FIG. 14 is a side view of portions of a device, with a grounding wire, in accordance with aspects of the invention.

FIG. 14 shows apportion of a device in accordance with aspects of the invention. The device is contained within a housing providing a vacuum. The housing has a window transparent to x-rays, which are indicated by the vertical arrow extending from the electron target 1421 through the housing window in FIG. 14. The device comprises a drive roller 1413, driven by a motor (not shown), a continuous band 1411, which is driven by the drive roller in the direction indicated by the arrows adjacent to the continuous band, a contact rod 1415, and a grounding mesh 1427. The grounding mesh is configured so that it is in contact with the housing, and can act as a Faraday cage for the charge on the loop. This electrical shielding may be used to increase the potential at the target. In some embodiments, the mesh can also be in contact with the continuous band, thereby grounding the band to the housing. Grounding of the band may reduce unwanted charge levels on the band prior to generation of charge through contact with the contact rod 1415.

Figure 15:
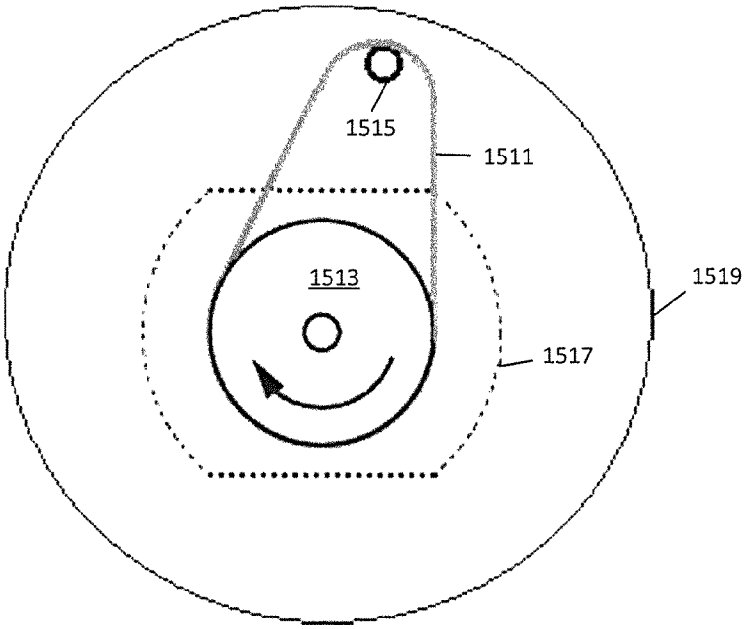
FIG. 15 is a front view showing portions of a device in accordance with aspects of the invention.

FIG. 15 is a front view showing portions of another x-ray generating device in accordance with aspects of the invention. The device of FIG. 15 includes a cylindrical housing 1519. The housing is configured to maintain a chamber within the housing at a low fluid pressure. Walls of the housing are generally opaque to x-rays.

A band 1511, for example such as discussed with respect to other embodiments, is within the housing. The band is looped around a drive roller 1513 and contact material, for example a contact rod 1515. The contact material may be, for example, contact material as discussed with respect to other embodiments. A drive system, for example including a motor 1517, drives the roller, causing surface areas of the band to be in changing contact with the contact material. With appropriate selection of the material of the band and the contact material, a charge imbalance develops between the two materials, and electrons may be accelerated towards an electron target (not shown in FIG. 15), which may comprise for example a metal. The electron target may be considered to be positioned towards a front of the housing, for example with respect to FIG. 15 in a direction that may be considered out of the page. In some embodiments the electron target may be on an interior surface of a window of the housing, the window being substantially transparent to x-rays. The electron target may in such embodiments be, for example, a metal sputtered onto an interior surface of the window. In some embodiments the electron target may form, be part of, or be attached to a divider within the housing. In some such embodiments a further wall including the window substantially transparent to x-rays may be further to a front of the housing. In some embodiments the divider may form an internal wall of a sub-chamber within the housing, with the sub-chamber being maintained at a low fluid pressure.

Figure 16:
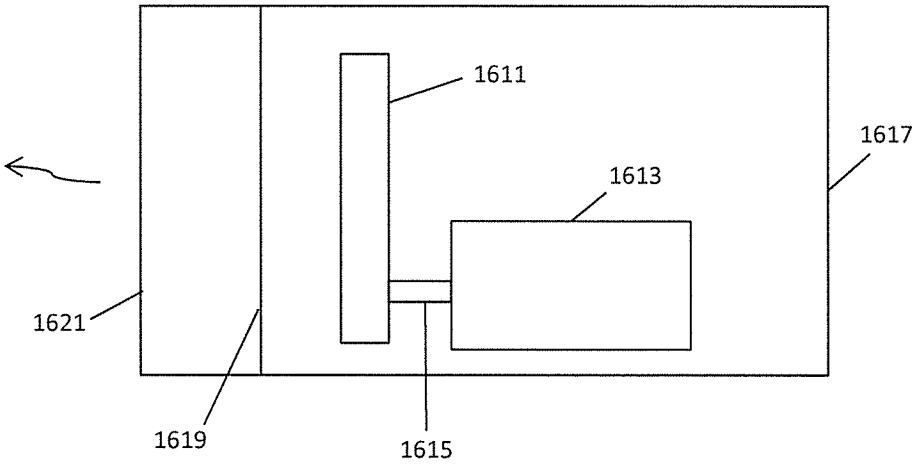
FIG. 16 is a side view showing portions of a device in accordance with aspects of the invention, for example a device such as the device of FIG. 15.

FIG. 16 is a side view showing portions of a device such as the device of FIG. 15. As with the device of FIG. 15, the device of FIG. 16 includes a band 1611 looped around a drive roller and contact material, with the drive roller coupled by an axle 1615 to a motor 1613. As shown in FIG. 16, the band is within a housing 1617, for example a cylindrical housing. The housing is configured to maintain a low fluid pressure within at least portions of the housing. Operation and materials of the band and the contact material may be as discussed with respect to FIG. 15.

In the device of FIG. 16, an electron target 1619 is forward of the band, and within the cylindrical housing (in some formulations, the electron target may be considered to form an exterior wall of the housing or a chamber of the housing). Further forward of the electron target is an exterior wall 1621 of the housing, with the exterior wall including a window substantially transparent to x-rays. In some embodiments, the electron target may instead be on an interior surface of the window.

Although the invention has been discussed with respect to various embodiments, it should be recognized that the invention comprises the novel and non-obvious claims supported by this disclosure.

What is claimed is:

1. An x-ray device comprising:

a housing configured for maintenance of a low fluid pressure environment in a chamber of the housing, the housing having a window, the housing being substantially opaque to x-rays other than the window, which is substantially transparent to x-rays;

a driving roller;

a motor for driving the driving roller;

a contact rod at least partially within the chamber;

a continuous band looped around the driving roller and in contact with the contact rod, the continuous band defining a loop with at least a portion of the contact rod within the loop, the continuous band and the contact material being comprised of materials such that varying contact between the continuous band and the contact material generates relative charge imbalance.

2. The x-ray device of claim 1, wherein the surface of the contact rod is dimpled.

3. The x-ray device of claim 1, wherein the surface of the contact rod includes cavities.

4. The x-ray device of claim 1, wherein the surface of the contact rod is splined.

5. The x-ray device of claim 1, further comprising a conductive paste on at least a portion of the contact rod.

6. The x-ray device of claim 1, further comprising a tensioner for the continuous band.

7. The x-ray device of claim 1, wherein the surface of the contact rod comprises Molybdenum.

8. The x-ray device of claim 1, wherein the continuous band includes surface patterning.

9. The x-ray device of claim 8, wherein the surface patterning comprises dimples in the continuous band.

10. The x-ray device of claim 8, wherein the surface patterning includes holes in the continuous band.

11. The x-ray device of claim 1, wherein the motor is reversible under operation.

12. The x-ray device of claim 1, further comprising a collimator translatable over different portions of the window.

13. The x-ray device of claim 1, further comprising at least one secondary roller, and wherein the continuous band is looped around at least one secondary roller.

14. The x-ray device of claim 1, wherein the continuous band comprises an electrically insulating material.

15. The x-ray device of claim 1, wherein the contact rod comprises an electrically conductive material.

16. The x-ray device of claim 1, wherein the continuous band comprises a polyimide film.

* * * * *